US006660110B1

(12) United States Patent
Gayda et al.

(10) Patent No.: US 6,660,110 B1
(45) Date of Patent: Dec. 9, 2003

(54) HEAT TREATMENT DEVICES AND METHOD OF OPERATION THEREOF TO PRODUCE DUAL MICROSTRUCTURE SUPERALLOY DISKS

(75) Inventors: John Gayda, Avon Lake, OH (US); Timothy P. Gabb, Independence, OH (US); Peter T. Kantzos, Canton, OH (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 89 days.

(21) Appl. No.: 10/118,625

(22) Filed: Apr. 8, 2002

(51) Int. Cl.[7] ..... C22F 1/10

(52) U.S. Cl. ..... 148/675; 148/902; 266/44; 266/249; 266/258; 266/260; 419/29

(58) Field of Search ..... 266/44, 258, 260, 266/249; 419/29; 148/902, 674, 675, 677

(56) References Cited

U.S. PATENT DOCUMENTS 3,835,282 A * 9/1974 Sass et al. ..... 219/635
4,820,358 A 4/1989 Chang
5,269,857 A * 12/1993 Ganesh et al. ..... 148/675
5,312,497 A 5/1994 Mathey
5,527,020 A 6/1996 Ganesh
5,527,402 A 6/1996 Ganesh
5,571,345 A 11/1996 Ganesh
6,132,535 A 10/2000 Okada
6,175,495 B1 1/2001 Batchelder
6,478,896 B1 * 11/2002 Ganesh et al. ..... 148/428

* cited by examiner

*Primary Examiner*—John Sheehan
(74) *Attorney, Agent, or Firm*—Kent N. Stone

(57) ABSTRACT

A heat treatment assembly and heat treatment methods are disclosed for producing different microstructures in the bore and rim portions of nickel-based superalloy disks, particularly suited for gas turbine applications. The heat treatment assembly is capable of being removed from the furnace and disassembled to allow rapid fan or oil quenching of the disk. For solutioning heat treatments of the disk, temperatures higher than that of this solvus temperature of the disk are used to produce coarse grains in the rim of each disk so as to give maximum creep and dwell crack resistance at the rim service temperature. At the same time, solution temperature lower than the solvus temperature of the disk are provided to produce fine grain in the bore of the disk so as to give maximum strength and low cycle fatigue resistance.

8 Claims, 4 Drawing Sheets

HEAT TREATMENT DEVICES AND METHOD OF OPERATION THEREOF TO PRODUCE DUAL MICROSTRUCTURE SUPERALLOY DISKS

ORIGIN OF THE INVENTION

The invention described herein was made in the performance of work under a NASA contract and is subject to the provisions of Section 305 of the National Aeronautics and Space Act of 1958, Public Law 85–568 (72 Stat.435;42 U.S.C.2457).

FIELD OF THE INVENTION

The invention relates to an apparatus and method of operation thereof for heat treating a disk so as to produce a dual microstructure superalloy disk particularly suited for gas turbine applications.

BACKGROUND OF THE INVENTION

There are numerous incidents where operating conditions experienced by an article, or a component of a machine, place different material property requirements on different portions of the article or component. Examples include a crank shaft in an internal combustion engine, a piston rod in a hydraulic cylinder, planatary gears for an automotive transmission, and a turbine disk for a gas turbine engine. Gas turbine disks are often made from nickel-base superalloys, because these disks need to withstand the temperature and stresses involved in the gas turbine cycle. In the bore portion of the disk where the operating temperature is somewhat lower, the limiting material properties are often tensile strength and low-cycle fatigue resistance. In the rim portion of the disk, where the operating temperatures are higher than those of the bore, because of the proximity to the combustion gases, resistance to creep and cracking are the limiting properties.

Advanced nickel-base, gamma prime strengthened superalloys have been introduced to the field that allow improved engine performance through higher disk temperatures as compared to current engines. This is achieved by using high levels of gamma prime and refractory elements. However, there is a long term need for disks with higher rim temperature capabilities of 1400° F. or more. This increased temperature capability would allow higher compressor exit temperatures of a gas turbine and allow the full utilization of advanced combustion and airfoil concepts for aerodynamic applications. These disks require high creep resistance and dwell crack growth resistance of coarse grain microstructures in the rim region near 1400° F., while still maintaining the high strength and low cycle fatigue resistance of fine grain microstructures in the bore region near 800–1200° F.

The chief determinant of achieving grain size in powder metallurgy superalloy disks is the temperature at which the alloy is solution heat treated. As is known in the art, solution heat treatment is concerned with the solvus temperature; i.e., the temperature at which all of the gamma prime strengthening precipitate of the superalloy goes into solution. To perform the desired solution heat treatment in this invention, it is necessary to solution heat treat the disk in a way whereby the rim is heated to a higher solution heat treatment temperature than the bore. Furthermore, it would be necessary at the same time, as known in the art, to be able to directly quench the disk after the solution heat treatment to achieve high tensile strength and low cycle fatigue resistance in the bore and high creep resistance in the rim.

For most gas turbine applications, disks are currently heat treated at uniform solution temperature either below the gamma prime solvus temperature (subsolvus heat treatments), or above the solvus temperature (supersolvus heat treatments). Several recent approaches have been established which differ from the traditional subsolvus or supersolvus heat treatment. One approach, more fully described in U.S. Pat. No. 5,312,497, uses induction heating to preferentially heat the rim of a disk, while a pressurized gas is run through the bore of the disk to keep the bore and web cooler. Another approach, more fully described in U.S. Pat. Nos. 5,527,020 and 5,527,402, uses simpler top and bottom thermal caps placed over the bore of the disk to blow pressurized air through the center of a single disk, while the disk is being held at a constant temperature in a gas fired furnace. In this way, the bore of the disk is maintained at a sufficiently cooler temperature than the rim of the disk, thus, achieving desired subsolvus solution of the bore and desired supersolvus solution of the rim.

Uniform disk temperature heat treatments produce either fine or coarse grain microstructures throughout the disk. The fine grain microstructure has inferior creep and dwell crack growth resistance for rim service temperatures. Similarly, the coarse grain microstructure has inferior tensile and low cycle fatigue resistance for bore service temperatures. The approach described in U.S. Pat. No. 5,312,497, using induction heating of the rim with pressurized gas cooling of the bore can only be applied to one disk at a time, and is thereby very expensive. The practice of U.S. Pat. No. 5,312,497 is also very sensitive to induction coil-disk geometry tuning, disadvantageously yielding difficult process control. The approach described in U.S. Pat. Nos. 5,527,020 and 5,527,402, also is limited to heat treating one disk at a time. The practice of U.S. Pat. Nos. 5,527,020 and 5,527,402, while having reduced complexity compared to the practice of U.S. Pat. No. 5,312,497, still requires specialized air pressure lines going into a furnace that must remain operable for process viability. Accordingly, there still remains a need to provide heat treatment devices, and methods of use thereof, that provide different microstructures in the bore and rim portions of nickel-base superalloy disks without suffering the drawbacks of the prior art techniques.

OBJECTS OF THE INVENTION

It is a primary object of the present invention to provide a heat treatment apparatus and method of use thereof. The heat treatment yields rim portions of superalloy disks as having higher temperature capabilities associated with coarse grain microstructures, while at the same time maintaining high strength and low cycle fatigue resistance of fine grain microstructures in the bore portions of superalloy disks near 800–1200° F.

It is another object of the present invention to provide for different microstructures in the bore and rim portions of nickel-base superalloy disks and accomplish such by the use of standard production furnaces without auxiliary cooling.

It is further desired to provide differential microstructures in the rim and bore portions of nickel-base superalloy disks while still maintaining the option for rapid cooling upon completion of the solution heat treatment using conventional fan or oil quenching operations.

A further object of the present invention is to provide for design of the heat treatment device using a finite element computer code and solvus data of the disk alloy.

SUMMARY OF THE INVENTION

This invention is directed to a heat treatment apparatus and methods of use thereof which produce different microstructures in the bore and rim portions of nickel-base superalloy disks particularly suited for gas turbine engines.

In one embodiment, an apparatus is provided that is insertable and removable from a heat treatment furnace for differentially heat treating a superalloy disk to obtain a dual microstructure disk. The disk comprises an inner section termed the bore with a bore hole, an intermediate section termed the web portion, an outer section termed the rim portion, and first and second faces on opposite sides of the disk. The disk has predetermined diameter and thickness dimensions. The apparatus comprises first and second thermal blocks, respectively, arranged on the first and second faces of the disk. Each of the first and second thermal blocks has predetermined diameter and thickness dimensions related to the predetermined diameter and thickness dimensions of the disk by a predetermined relationship. The diameters of the first and second thermal blocks are less than the diameter of the disk. The first and second thermal blocks each have have upper and lower faces with the lower face of the first thermal block having an alignment pin positionable in correspondence with the bore hole of the disk and the upper face of the second thermal block having an alignment pin positionable in correspondence with the bore hole of the disk so that the first and second thermal blocks along with the disk are brought together and expose at least the rim portion of the disk. The apparatus further comprises first and second insulation jackets that surround the first and second thermal blocks. Each insulating jacket consists of an alignment plate, outer shell, and insulating media. The first and second alignment plates are respectively fastened to the upper face of the first thermal block and to the lower face of the second thermal block. The alignment plates have diameters greater than the thermal blocks. The apparatus still further comprises first and second outer shells respectively located outside of the first and second alignment plates with high temperature insulating media filling the cavity between the outer shells and thermal blocks.

The invention provides a method for differentially heat treating a superalloy disk having a gamma prime solvus temperature so as to obtain a dual microstructure disk. The method includes providing first and second thermal blocks respectively arranged on first and second faces of a disk. Each of the first and second thermal blocks has predetermined diameter and thickness dimensions related to the predetermined diameter and thickness dimensions of the disk by a predetermined relationship. The first and second thermal blocks each has upper and lower faces, with the lower face of the first thermal block having an alignment pin positionable in correspondence with the bore hole of the disk, and the upper face of the second thermal block having an alignment pin positionable in correspondence with the bore hole of the disk. The diameters of the first and second thermal blocks are less than the diameter of the disk. The method further includes providing first and second alignment plates each with a diameter greater than the diameter of the first and second thermal blocks and having means for being respectively fastened to the upper face of the first thermal block and to the lower face of the second thermal block. The method further comprises providing first and second outer shells respectively located outside of the first and second alignment plates with high temperature insulating media filling the cavity between the thermal blocks and outer shells. The method further includes the following steps: (1) positioning each of the alignment pins of the first and second thermal blocks in correspondence with the bore hole of the disk; (2) bringing together the first and second thermal block, the first and second shells with the associated high temperature insulating media and the disk thereby exposing the rim portion of the disk; (3) selectively attaching a thermocouple to either the first or second thermal block; (4) placing the brought together disk, the first and second thermal blocks, the first and second shells with the associated high temperature insulating media, and the thermocouple in a furnace; (5) heat treating the disk with heat sink assembly in a standard production furnace maintained at a temperature which is above the gamma prime solvus temperature of the disk for a first predetermined duration; (6) removing the disk and heat sink assembly from the furnace when the thermocouple reaches the subsolvus temperature of the disk alloy; (7) freeing the disk from the heat sink assembly; and (8) quenching the disk.

DETAILED DESCRIPTION OF THE PREFERRED EMBODIMENTS

Figure 1:
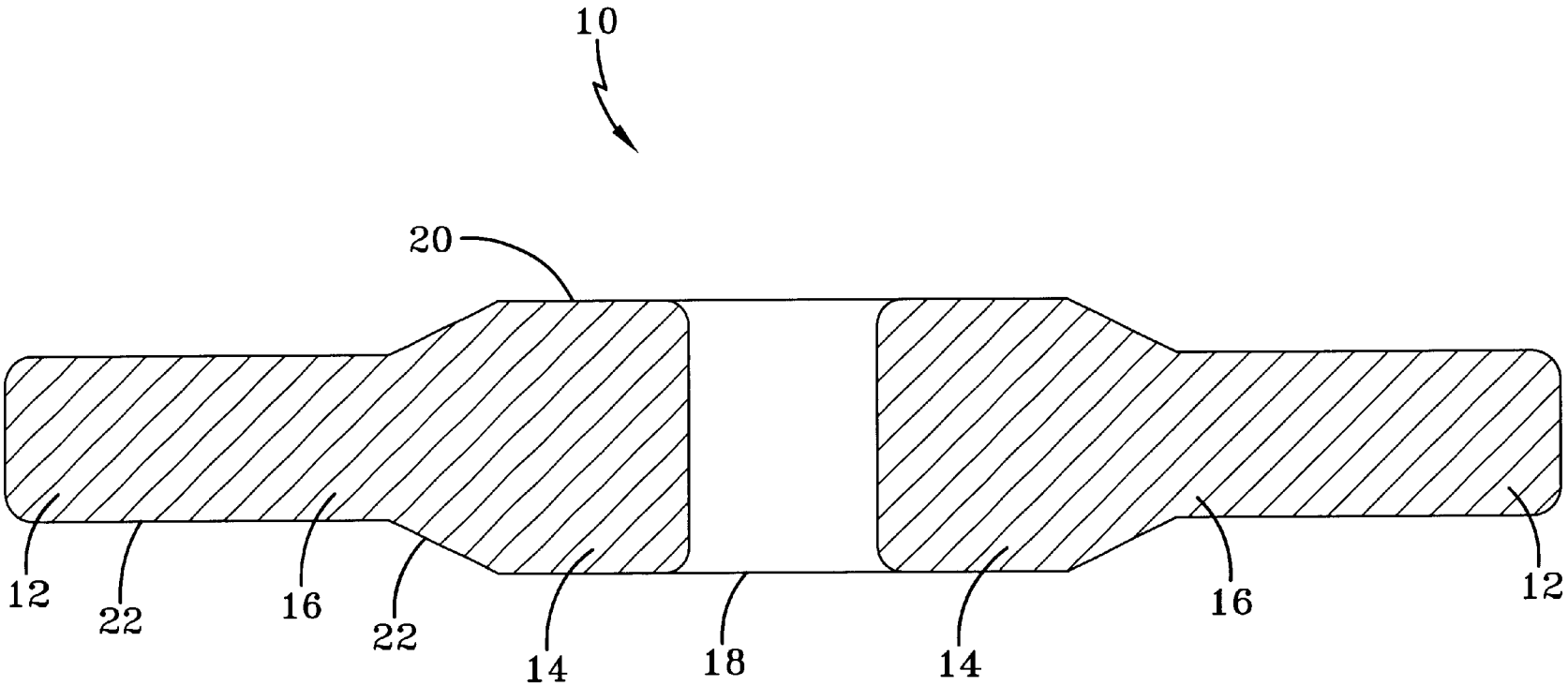
FIG. 1 is a schematic cross-sectional view of a disk shape for a gas turbine engine.

With reference to the drawings, wherein the same reference number indicates the same element throughout, there is shown in FIG. 1 an article which is differentially heat treated in accordance with the practice of the present invention. More particularly, FIG. 1 shows a typical disk 10 for a gas turbine and is generally illustrated by reference number 10. Each of the various disks 10 contemplated by the practice of the present invention has predetermined diameters and thickness dimensions covering a wide range of sizes all handled by a heat treatment device to be described hereinafter with reference to FIG. 2.

The disk 10 has a typical diameter of thirteen (13) inches, a typical height of two (2) inches at its central region and a typical height of one (1) inch at its outer region. The disk 10 is comprised of an outer section rim portion, to be further defined hereinafter with reference to FIG. 2, occupying a predetermined region at the outer region of the disk 10 and generally shown by reference number 12, an inner section bore portion 14 generally shown by reference number 14, and a connecting or intermediate section web portion generally shown by reference number 16. A central bore hole 18, through the bore portion 14, is illustrated and is an essential feature of the turbine disk 10. The disk 10 additionally comprises a first face 20, and a second face 22, each of which extends over the rim, web, and bore portions of the disk 10 and are on opposite sides of the disk 10. The disk 10 is advantageously solution heat treated by the use of a heat treatment device 24 of the present invention, which may be further described with reference to FIG. 2.

Figure 2:
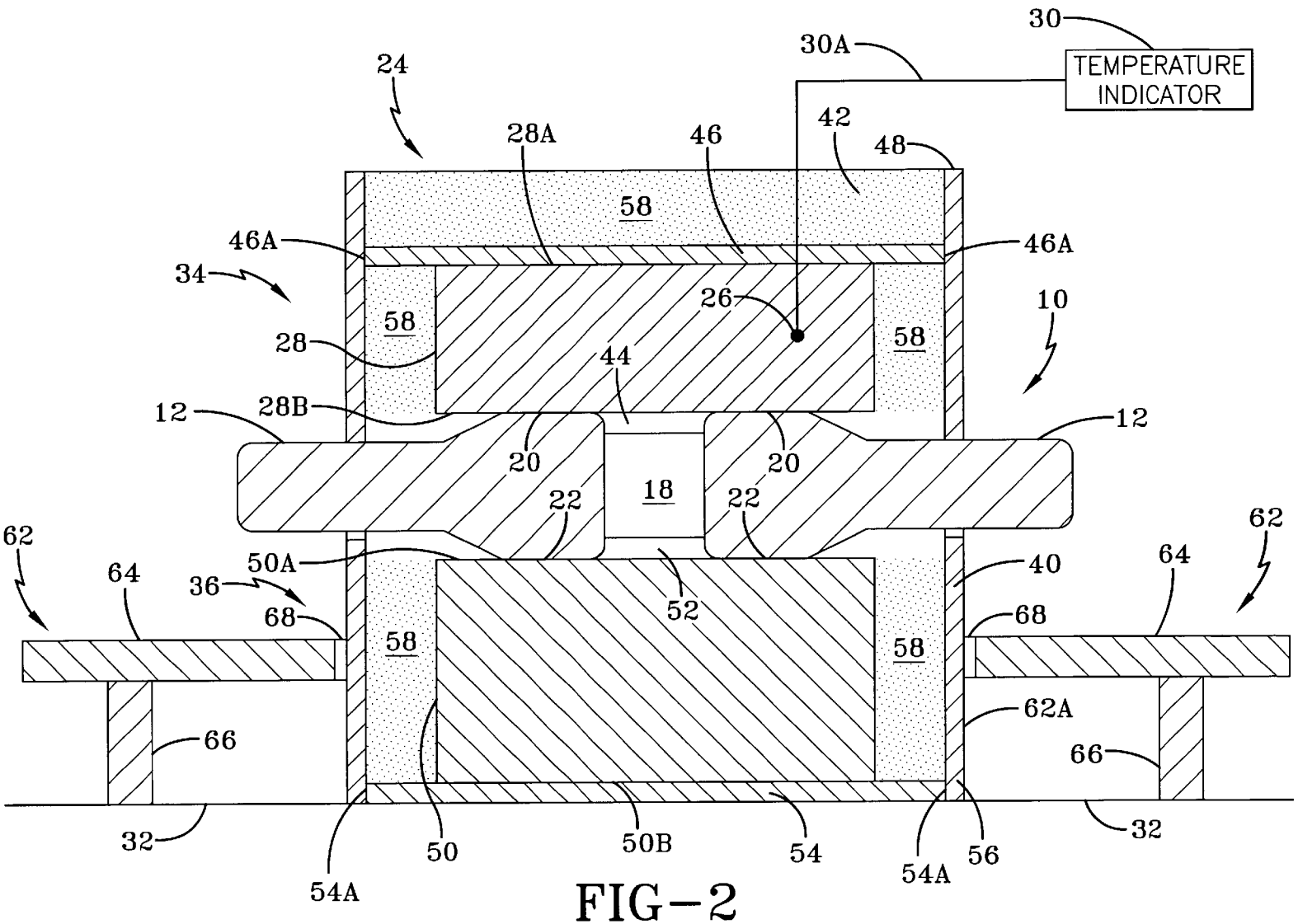
FIG. 2 is a cross-sectional view of a heat treatment apparatus of the present invention used for differentially heating a disk so as to provide a dual microstructure thereof.

FIG. 2 illustrates the heat treatment assembly 24, which rests on a production heat treatment grate 32 of a standard gas-fired furnace to be described hereinafter and comprises top and bottom heat sinks 34 and 36. The heat sinks, 34 and 36, except for their insulative members to be further described, can be fabricated from any metal or alloy which can withstand the heat treatment temperatures. Carbon steel serves well for this purpose and can also be used to minimize cost of the heat treatment assembly 24. The heat treatment assembly 24 also contains a thermocouple 26 that is preferably placed in a thermal block 28 near the bore portion 14 of the disk 10. The thermocouple 26 is connected to a temperature indicator 30 by way of signal path 30A. The thermocouple 26 derives an electrical signal representative of the temperature of the thermal block 28 and, more importantly, the temperature of the bore portion 14 of the disk 10.

Each heat sink 34 or 36 has four components; a thermal block, an alignment pin, an alignment plate, and an outer shell, which for heat sink 34 are respectively shown with reference numbers 28, 44, 46, and 48 and, similarly, these four components are respectively shown for heat sink 36 with reference numbers 50, 52, 54, and 56. For the disk 10 shown in FIG. 1, the thermal block 28 has typical dimensions of a diameter of six (6) inches and a height of two (2) inches, whereas thermal block 50 has typical dimensions of a diameter of six (6) inches and a height of three (3) inches. The alignment plates 46 and 54 have typical dimensions of a diameter of eight (8) inches and a thickness of 0.25 inches. The outer shells 48 and 56 are essentially pipe sections preferably comprised of carbon steel and have a typical diameter of eight (8) inches.

The rim portion 12 is defined herein as that portion of the disk 10 extending outside of the shells 48 and 56. The thermal blocks 28 and 50 are defined herein as having diameters which are less than the diameters of the shells 48 and 56 and also less than the diameters of the disk 10 receiving the heat treatment of the present invention.

The thermal blocks 28 and 50 are solid metal cylinders and are used to chill the central portion of the disk 10. The alignment pins 44 and 52 and alignment plates 46 and 54 are respectively connected by appropriate means, such as bolts, to the thermal blocks 28 and 50 to assure maintaining the concentricity of the disk 10, thermal blocks 28 and 50, and outer shells 48 and 56 during the heat treatment of the disk 10 to be described hereinafter. The alignment pins 44 and 52 and the alignment plates 46 and 54 provide concentric alignment of the thermal blocks 28 and 50 and the outer shells 48 and 56 relative to the geometric center of the disk 10 so as to ensure that the coarse and fine grain macrostructures resulting from the practice of the present invention, to be further described hereinafter with respect to FIG. 3, are also concentric after disk 10 is heat treated.

Insulating jackets, which are comprised of the outer shells 48 and 54 and high temperature insulating media, generally identified by reference number 58, minimize the temperature rise of the thermal blocks 28 and 50 and the central portion of the disk 10. Any high temperature insulating media, such as Kaowool™, can be used to fill the gaps between the outer shells 48 and 56 and the thermal blocks 28 and 50 as shown in FIG. 2.

The thermal block 28 has an upper face 28A and a lower face 28B, similarly, the thermal block 50 has an upper face 50A and a lower face 50B. The lower face 28B of the thermal block 28 is mated with face 20 of the disk 10, whereas the upper face 50A of the thermal block 50 is mated with the face 22 of the disk 10. The thermal block 50 has the alignment pin 52 protruding from its upper face 50A, whereas the thermal block 28 has an alignment pin 44 protruding from its lower face 28B. The alignment pins 44 and 52 are positionable in correspondence with the bore hole 18 of the disk 10. The diameters of the thermal blocks 28 and 50 are less than the diameter of the disk 10 by a predetermined amount so as to expose the outer periphery of the disk 10.

The alignment plates 46 and 54 have respective peripheries 46A and 54A. Further, the alignment plates 46 and 54, each has a diameter greater than the diameter of the thermal blocks 28 and 50 and each has appropriate means, such as bolts (not shown) for being respectively fastened to the upper face 28A of the thermal block 28 and to the lower face 50B of the thermal block 50.

The outer shells 48 and 56 are respectively located outside of, but near the periphery 46A and 54A of the alignment plates 46 and 54. The outer shells 48 and 56 are dimensioned so as to slide over the respective alignment plates 46 and 54. The outer shells 48 and 56 are preferably spaced apart from each other by an amount, which is somewhat greater than the predetermined thickness of the rim portion 12 of the disk 10. For one embodiment, the outer shell 48 rests on the disk 10, whereas the outer shell 56 is free of contact with the disk 10. This results in maximum thermal contact of disk 10 and thermal block 50.

The heat treatment assembly 24 still further preferably comprises a special purpose rack 62 comprised of a heat resistant material and having a frame 64 for holding the disk 10. The frame 64 also has a supporting legs 66. The frame 64 has a clearance hole 68 with a typical diameter of nine (9) inches so that the frame 64 may slide over the outer shell 56.

Figure 3B:
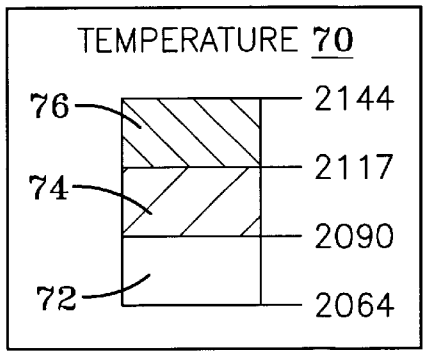
FIG. 3 is composed of FIGS. 3(A) and 3(B) which show the predicted thermal gradients in a disk and the thermal block of the heat treatment apparatus at a specific time at an elevated temperature based on calculations obtained using a finite element computer code.
Figure 3A:
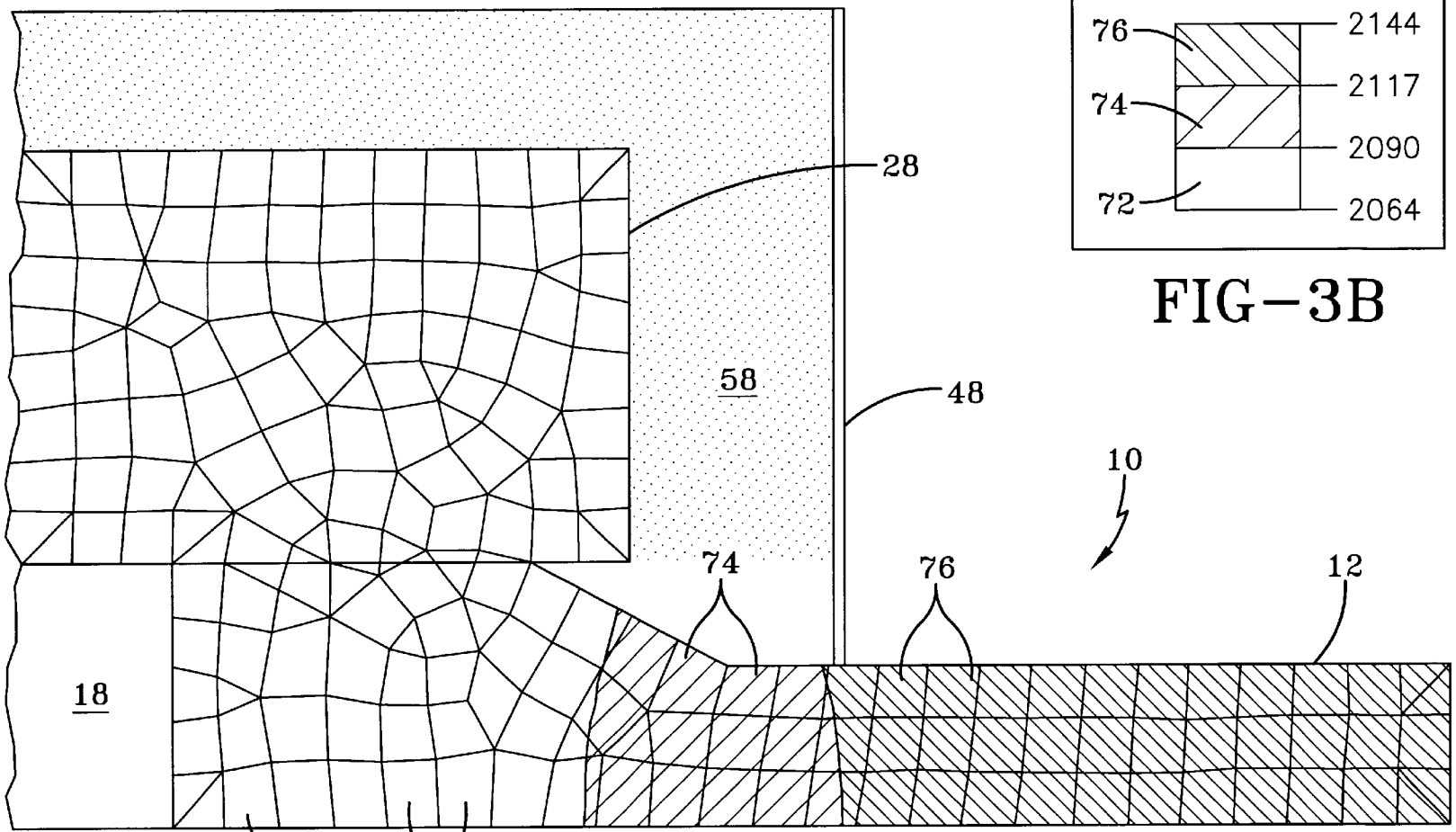

The heat sinks 34 and 36 are designed to enhance and maximize the natural thermal gradient between the interior bore 14 and periphery rim 12 of the disk 10. These heat sinks 34 and 36 and the accompanying thermal cycle, to be further described hereinafter with reference to FIG. 3, operatively cooperate to produce a fine grain bore 14 and a coarse grain rim 12 in the disk 10 in a standard furnace without the aid of auxiliary cooling. The dimensions of the thermal blocks 28 and 50 and the outer shells 48 and 56, having the typical values previously described with reference to FIG. 2, are related to the dimensions of the disk 10 by a predetermined relationship that may be determined using commercially available finite element heat transfer computer code. An example of one embodiment of the present invention and the thermal gradients thereof are depicted in FIG. 3, which is composed of FIGS. 3(A) and 3(B). FIG. 3 shows the thermal gradient in a typical disk 10 used in a turbine application and schematically illustrated in FIG. 3, as having mated thereto a thermal block, such as thermal block 28, and an insulating jacket, defined by outer shell 48. The thermal gradients are illustrated for a specified time at an elevated temperature.

FIGS. 3(A) and 3(B) are interrelated, wherein FIG. 3(A) shows a Finite Element Analysis (FEA) prediction and FIG. 3(B) illustrates associated temperatures. The (FEA) prediction is the condition occurring after subjecting the disk 10 and thermal block 28 to an elevated temperature of 2150° F. for a duration of about 1.8 hours. FIG. 3(B) illustrates a temperature range 70 segmented into three temperatures ranges, which define regions 72, 74, and 76 having the clear and two different shaded portions shown in FIG. 3(B). These regions 72, 74 and 76 are shown in FIG. 3(A) as being associated with thermal block 28 and disk 10. As can be seen in FIG. 3, the temperature of the thermal block 28 and more importantly the central portion of the disk 10 corresponds to the lowest 72 (subsolvus) region, whereas the temperature at the rim 12 of the disk 10 corresponds at the highest 76 (supersolvus) region. Region 72 represents the fine grain region of the disk 10 and region 76 represents the coarse grain region of the disk 10 after completion of the heat treatment of the invention.

In operation, and in reference to FIG. 2, the first and second heat sinks 34 and 36 are selected in a manner as previously described and assembled with the disk 10 and heat treatment rack 62 on a standard production heat treatment grate 32. Thermocouple 26 is then preferably attached to thermal block 28, but it may alternatively be attached to thermal block 50.

The solution heat treatment of the present invention may be provided by standard gas-fired furnaces which may be of the type used by Ladish Company Inc., Wyman-Gordon Forging, or other heat treatment companies.

The heat treatment cycle is dependent on the alloy making up the disk 10, that is, its gamma prime solvus temperature and its incipient melting point. The method of the present invention first handles the heat treatment assembly 24, which is at room temperature, so as to be inserted into a furnace maintained at a temperature above the gamma prime solvus temperature of the alloy. It is desired that the furnace temperature be as high as possible without producing incipient melting of the alloy. For the class of alloys used for turbine applications, the upper limit of the furnace temperature is generally less than 2200° F. The method of the invention monitors the temperature of the bore portion 14 of the disk 10 by means of the thermocouple 26 and temperature indicator 30.

The heat treatment assembly 24 is removed from the furnace when the thermocouple 26 in the thermal block 28 reaches the subsolvus solution temperature of the disk alloy which is generally less than about 2100 F. At this point, the rim 12 of the disk 10 will have exceeded the solvus temperature of the alloy and, therefore, have a coarse grain microstructure, while the bore portion 14 of the disk 10 will have been maintained below the solvus temperature and, therefore, have a fine grain microstructure.

The heat sinks 34 and 36 are removed prior to the quenching to facilitate faster cooling of the disk 10. As is known in the art, this rapid quenching achieves high strength and creep resistance in the disk 10. Rapid removal of the heat sinks are facilitated by rack 62. Upon lifting rack 62, disk 10 and heat sink 34 can be removed from the furnace without heat sink 36. Once rack 62, disk 10, and heat sink 34 are out of the furnace, heat sink 34 can be rapidly removed from disk 10 and rack 62. This can be accomplished by any number of techniques readily available at heat treat shops which routinely handle metal parts at high temperature as heat sink 34 is not clamped to disk 10. Once heat sink 34 is removed, disk 10 now resting on rack 62 can be moved to existing cooling facilities for fan cooling or oil quenching.

It should now be appreciated that the practice of the present invention provides for a heat treatment assembly 24 in which the disk 10 is brought into contact with the heat sinks 34 and 36, and the solution treatment is performed in a desired manner. The heat sinks 34 and 36 are brought together with the disk 10 in a non-clamped manner so as to allow a relatively easy disassembly thereof. The removal of the heat sinks 34 and 36 allow the disk 10 to be easily moved and placed into an appropriate quenching station by moving the special rack 62 carrying the disk 10.

The heat treatment assembly 24 provides a compact arrangement for performing the desired heat treatment of the disk 10. Because of this compact arrangement multiple disks can be heat treated simultaneously, in accordance with the practice of the present invention, in a standard production furnace so as to decrease cost with minimal modification to the present invention.

In the practice of the invention, the method hereinbefore described was performed on a disk 10 mated with the heat treatment assembly 24 of FIG. 2, and some of the results thereof may be further described with reference to FIG. 4.

Figure 4:
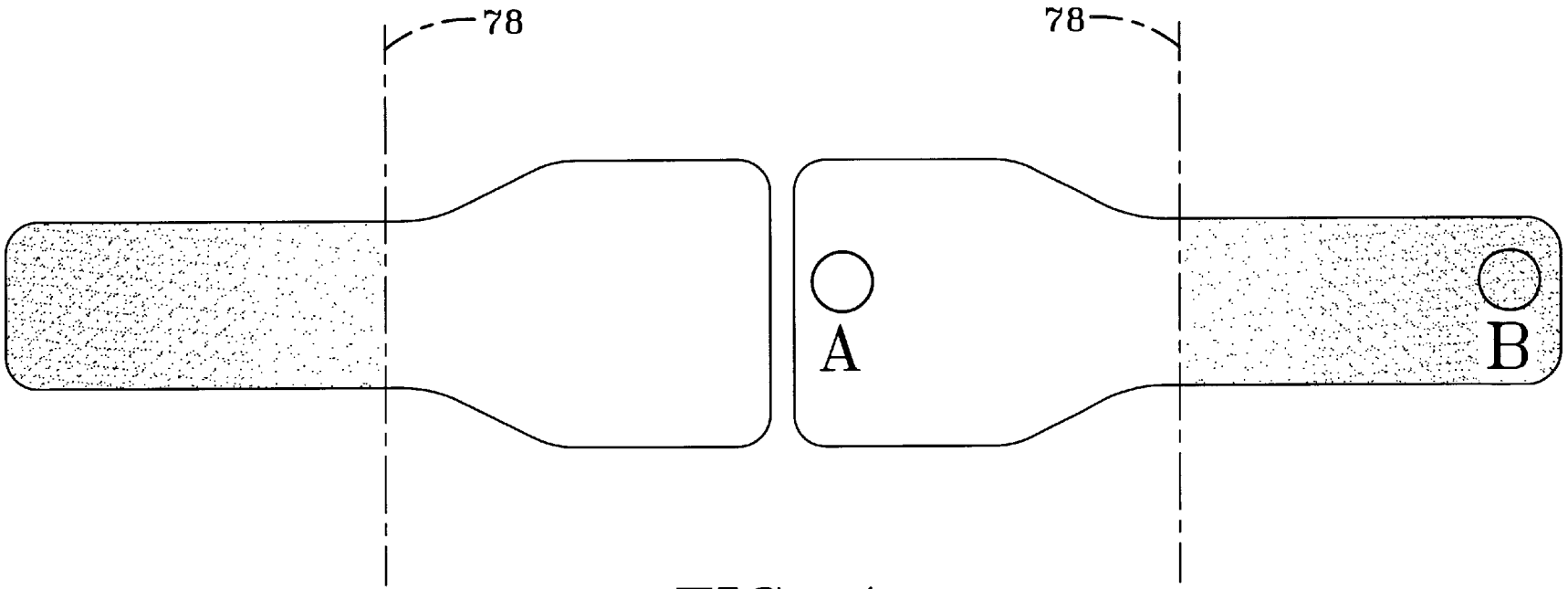
FIG. 4 illustrates a macro etched section of a turbine disk created by the practice of the present invention.

FIG. 4 shows macroetched section of an actual superalloy disk 10 after receiving the heat treatment of the present invention utilizing the heat treatment assembly 24. From FIG. 4 it should be noted that a fine grain region exists in the center of disk 10 (clear texture) at the bore portion 14 and a coarse grain region exists at the rim portion 12 of the disk 10 (speckled texture). The transition between the fine and coarse grain regions is generally identified in FIG. 4 by dimensional line 78. The grain size of the circle portion A located in the center of the disk 10 at the bore portion 14 is about 13 ASTM (American Society for Testing and Materials) and the grain size of the circle portion B located at the rim portion 12 of the disk 10 is about 7 ASTM.

It should now be appreciated that the practice of the present invention provides for a method to handle various articles, some of which are particularly suited as gas turbine disk, and all of which have a dual microstructure in which the rim portion of the article being treated has creep and dwell crack growth resistance of coarse grain microstructure operable at a temperature near 1400° F., while still maintaining the high strength and low cycle fatigue resistance of fine grain microstructure in the bore portion of the article being treated operable at a temperature of 800–1200° F.

It should now be appreciated that the practice of the present invention provides for a heat treatment assembly that accommodates superalloy disks. The practice of the present invention yields these disks having high creep resistance and dwell crack growth resistance of coarse grain microstructure in the rim portion 12 with an operating temperature near 1400° F., while at the same time maintaining high strength and low cycle fatigue resistance of fine grain microstructure in the bore region 14 having an operating temperature of between 800–1200° F.

The invention has been described with reference to the preferred embodiments and some alternates thereof. It is believed that many modifications and alterations to the embodiments as discussed herein will readily suggest themselves to those skilled in the art upon reading and understanding the detailed description of the invention. It is intended to include all such modifications and alterations insofar as they come within the scope of the present invention.

We claim:

1. An apparatus insertable and removable from a heat treatment furnace for differentially heat treating a superalloy disk to obtain a dual microstructure disk, the disk comprising an inner section termed the bore portion with a bore hole, an intermediate section termed the web portion, an outer section termed the rim portion, and first and second faces on opposite sides of the disk, said disk having predetermined diameter and thickness dimensions for each of said rim and bore portions, said apparatus comprising:

first and second thermal blocks respectively arranged on said first and second faces of said disk, each of said first and second thermal blocks having predetermined diameter and thickness dimensions related to said predetermined diameter and thickness dimensions of said disk by predetermined relationship, said diameters of said first and second thermal blocks being less than said diameter of said disk, said first and second thermal blocks each has upper and lower faces with the lower face of the first thermal block having an alignment pin positionable in correspondence with said bore hole of said disk and the upper face of the second thermal block having an alignment pin positionable in correspondence with said bore hole of said disk so that said first and second thermal blocks along with said disk are brought together and expose at least the rim portion of the disk;

first and second alignment plates each with a diameter greater than the diameter of said first and second thermal blocks and with a periphery and having means for being respectively fastened to the upper face of the first thermal block and to the lower face of the second thermal block; and first and second outer shells located outside of the periphery of said first and second alignment plates with high temperature insulating media filling the cavity between the outer shells and thermal blocks.

2. The apparatus according to claim 1 wherein said first and second shells are spaced apart from each other by an amount which is greater than said predetermined thickness of said rim portion.

3. The apparatus according to claim 1, further comprising a rack comprised of a heat resistant material and having a frame for holding and carrying said disk, said frame having supporting legs.

4. The apparatus according to claim 1, wherein said thermal blocks, said alignment plates and said outer shells are comprised of a carbon steel material.

5. The apparatus according to claim 1, wherein said apparatus further comprises a thermocouple capable of being attached to either said first or second thermal block.

6. A method for differentially heat treating a superalloy disk having a gamma prime solvus temperature to obtain a dual microstructure disk, said disk comprising an inner section termed the bore portion with a bore hole, an intermediate section termed the web portion, an outer section termed the rim portion, and first and second faces on opposite sides of the said disk, said disk having predetermined diameter and thickness dimensions for said rim and bore portions, providing first and second thermal blocks respectively arranged on said first and second faces of said disk, each of said first and second thermal blocks having predetermined diameter and thickness dimensions related to said predetermined diameter and thickness dimensions of said disk by a predetermined relationship, said diameter of said first and second thermal blocks being less than said diameter of said disk, said first and second thermal blocks each has upper and lower faces with the lower face of the first thermal block having an alignment pin positionable in correspondence with said bore hole of said disk and the upper face of the second thermal block having an alignment pin positionable in correspondence with said bore hole of said disk;

providing first and second alignment plates each with a diameter greater than the diameter of said first and second thermal blocks and with a periphery and having means for being respectively fastened to the upper face of the first thermal block and to the lower face of the second thermal block;

providing first and second outer shells respectively located outside of the periphery of said first and second alignment plates with high temperature insulating media filling the cavity between the outer shells and thermal blocks;

positioning each of said alignment pins of said first and second thermal blocks in correspondence with said bore hole of said disk;

bringing together said first and second thermal blocks, first and second alignment plates, the first and second shells with the associated high temperature insulating media, and said disk and exposing said rim portion;

selectively attaching a thermocouple to either said first or second thermal block;

placing the brought together disk, the first and second thermal blocks, first and second alignment plates, first and second shells with the associated high temperature insulating media, and the thermocouple in a furnace;

heat treating the disk in a furnace at a temperature which is above said gamma prime solvus temperature of said disk for a first predetermined duration;

removing the disk and heat treatment assembly from furnace when thermocouple reaches the subsolvus temperature of said disk alloy;

freeing said disk from heat treatment assembly; and quenching said disk.

7. The method according to claim 6 further providing a special purpose rack designed to facilitate rapid removal of heat sink assembly from said disk and also accomplish said quenching step.

8. The method according to claim 6, wherein said furnace temperature is above said gamma prime solvus temperature and is also selected to be below the incipient melting temperature of said disk alloy.

* * * * *